United States Patent [19]

Crnogorac

[11] 4,014,283

[45] Mar. 29, 1977

[54] WATERCRAFT, PARTICULARLY FOR WATERSPORTS

[76] Inventor: Ferdo Crnogorac, Marsala Tita 105, Bosanski Brod, Yugoslavia

[22] Filed: Nov. 18, 1975

[21] Appl. No.: 632,986

[30] Foreign Application Priority Data

Nov. 19, 1974 Yugoslavia ..... 3067/74

[52] U.S. Cl. ..... 115/70; 9/310 R; 280/21 A

[51] Int. Cl.[2] ..... B63B 35/72

[58] Field of Search ..... 115/70; 114/66.5 R, 114/66.5 H; 9/310 R, 310 B; 180/3 R; 280/21 R, 21 A

[56] References Cited

UNITED STATES PATENTS

| | | | |
|---|---|---|---|
| 2,817,101 | 12/1957 | Chaffee | 115/70 |
| 3,157,146 | 11/1964 | Billig | 114/66.5 H |
| 3,158,129 | 11/1964 | Mauer | 115/70 |
| 3,483,844 | 12/1969 | Trautwein | 115/70 |

FOREIGN PATENTS OR APPLICATIONS

| | | | |
|---|---|---|---|
| 1,503,213 | 10/1967 | France | 115/70 |
| 1,923,926 | 5/1969 | Germany | 280/21 R |

*Primary Examiner*—Trygve M. Blix
*Assistant Examiner*—Charles E. Frankfort
*Attorney, Agent, or Firm*—Herbert E. Kidder

[57] ABSTRACT

A watercraft comprising a flotation body having at least one seat for a rider, and front and rear tandem skis. The rear ski is flexibly connected to the body by spring supports, and the front ski is steerable by a steering column that passes upwardly through a bushing in the front end of the body. The bushing is pivoted about a transverse axis so that the steering column has limited swinging movement in a vertical longitudinal plane. The bottom end of the steering column is pivotally connected to the front ski near the midpoint thereof, and a resilient strut extends from the forward end of the ski to the steering column just below the bottom end of the bushing. A motor is mounted within the body and has a drive shaft extending downwardly to drive a propeller located below the bottom surface of the skis. The drive shaft is pivoted for fore-and-aft swinging movement, and an adjustable link connects the bottom end of the drive shaft to the top end of the bushing. When the top end of the steering column is pulled rearwardly, the front end of the front ski is raised and, at the same time, the bottom end of the drive shaft with its propeller is swung rearwardly.

5 Claims, 2 Drawing Figures

WATERCRAFT, PARTICULARLY FOR WATERSPORTS

The present invention relates to a watercraft, particularly for water sports, having a float and a motor drive. Such watercraft are usually designed for one to two people.

In the presently known watercraft of this type, the float is designed as a gliding body. These gliding bodies have different forms. Thus, for example, motorized surf boards are known which can be used standing up. However, in general, these watercraft are nothing other than modified, that is, reduced gliding boats with a motor drive. The disadvantages of these watercraft are that they have only a limited maneuverability, since a change of direction must be made very carefully because of the risk of capsizing. This peculiarity limits its use in sports. The poor maneuverability is further increased by the fact that the steering of these watercraft is effected in known manner by turning the driving unit. This type of steering is relatively cumbersome, however, because of the great weight of these driving units.

The primary object of the present invention, therefore, is to provide a watercraft that is easier to handle, and is thus particularly suitable for sporting purposes.

This problem is solved according to the invention in that the float of the watercraft is secured on at least two skis, of which at least one is steerable. Such a watercraft glides in this case not on the float, but on the skis to which the float is secured, which results in a lesser water resistance. Moreover, the watercraft is much easier and better to handle by the steerable ski, so that even rapid changes of direction, for example rides on a narrow circular path and zig-zag rides between buoys are possible.

In the design according to the invention, two skis are arranged in tandem underneath the float. The ride with such a watercraft is similar to that of a motorcycle, in that curves can be started and taken by inclining the watercraft and corresponding steering movements. The front ski can be steered according to another feature of the invention by a steering column mounted on the float, and according to another feature of the invention, the steering column is mounted in a guide bushing in the float. This type of steering corresponds substantially to the steering arrangement of a motorcycle.

The invention also provides a pivoted arrangement of the guide bushing in the float, so that it can be tilted at least about a horizontal transverse axis. This has the advantage that the angle of incidence of the steerable ski can be varied by tilting the steering column in the direction of the longitudinal axis of the watercraft, which facilitates particularly the transition from displacement ride to planing ride, and shortens the braking distance when braking the watercraft.

According to the invention it is also suggested to connect the skis elastically with the float. In contrast to the known watercraft of the above-mentioned type, this ensures a comfortable ride even at high speeds. The suspension system can be so designed that the steerable ski or skis are suspended on the steering column and/or the non-steerable ski or skis on a rigid strut on the float in the manner of a rocking arm over a swivel joint, with a horizontal swivel axis extending in the transverse direction; the swivel movements being cushioned by vibratory springs arranged at a distance from the swivel joints and acting on the skis.

An improvement in the comfort is also achieved by providing a telescopic spring between the swivel joints and the steering column or the strut or struts. It is advisable to damp the vibratory springs and the telescopic springs, if any, with a damping device. Such a damping device can be designed, for example, as a hydraulic or mechanical shock absorber and serves to absorb the vibrations of the springs under the action of the water shocks.

The invention also teaches the idea of connecting the upper end of the vibratory springs acting on the steerable ski with the steering column just below the guide bushing in such a way that the steering column tilts to the rear at its upper end under the action of the spring force. This facilitates the tilting of the steering column during the start of the watercraft, and thus the adjustment of the steerable ski, since the adjusted ski itself turns the guide bushing and thus the steering column to the rear.

Furthermore, it is suggested according to the invention to arrange the motor drive between the skis. This permits a particularly compact design of the watercraft and ensures a symmetrical distribution of the weight forces on the skis. The motor drive can be designed like an outboard motor, the motor being in the float and having a shaft projecting vertically downward from the float, at the bottom end of which is arranged a screw propeller.

According to another feature of the invention, at least the propeller drive shaft is pivotally mounted and so connected with the guide bushing by means of a tie rod that in a tilting movement of the upper end of the steering column to the rear, the shaft of the motor drive likewise tilts to the rear. This has the result that the propeller axis is always horizontal, so that the propeller can develop maximum thrust, which is particularly necessary at the start.

The invention will be described more fully, with reference to the drawing of the preferred embodiment.

Figure 1:
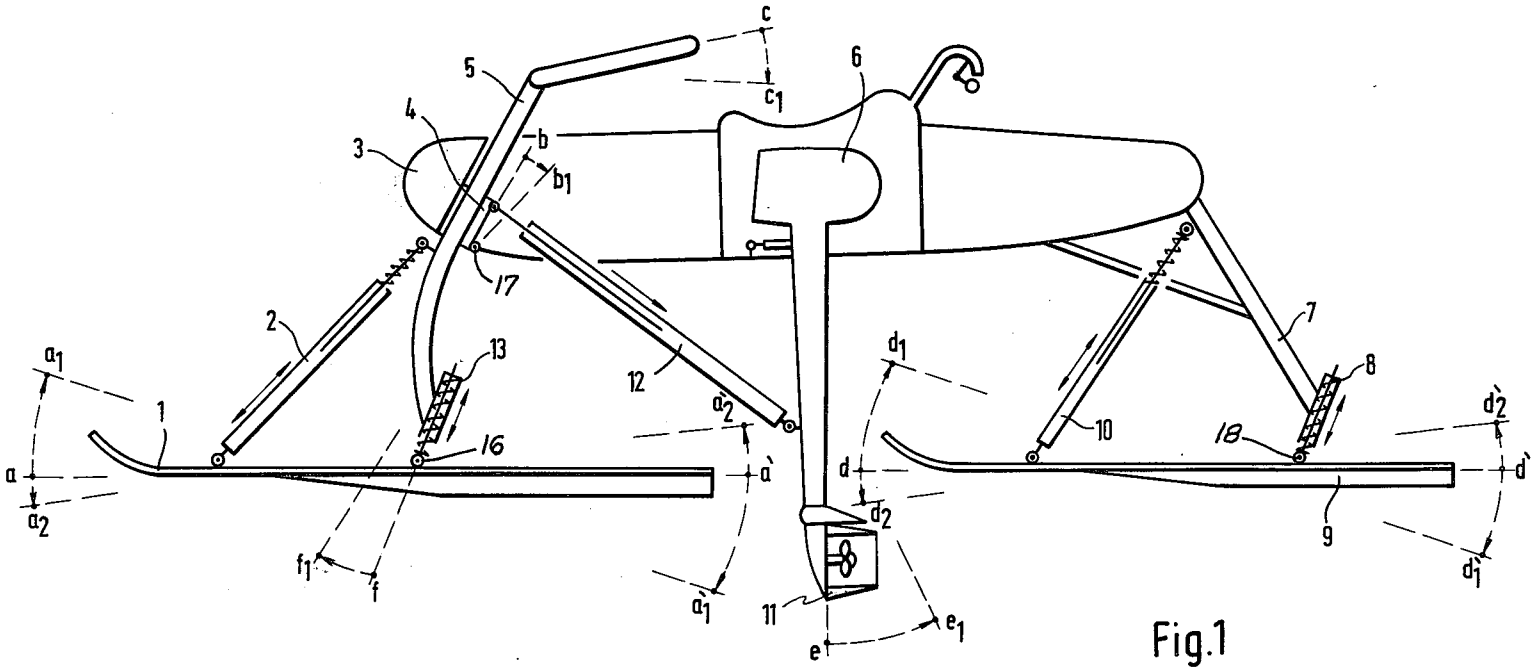
FIG. 1 shows a side elevation of a watercraft, partially cut away.
Figure 2:
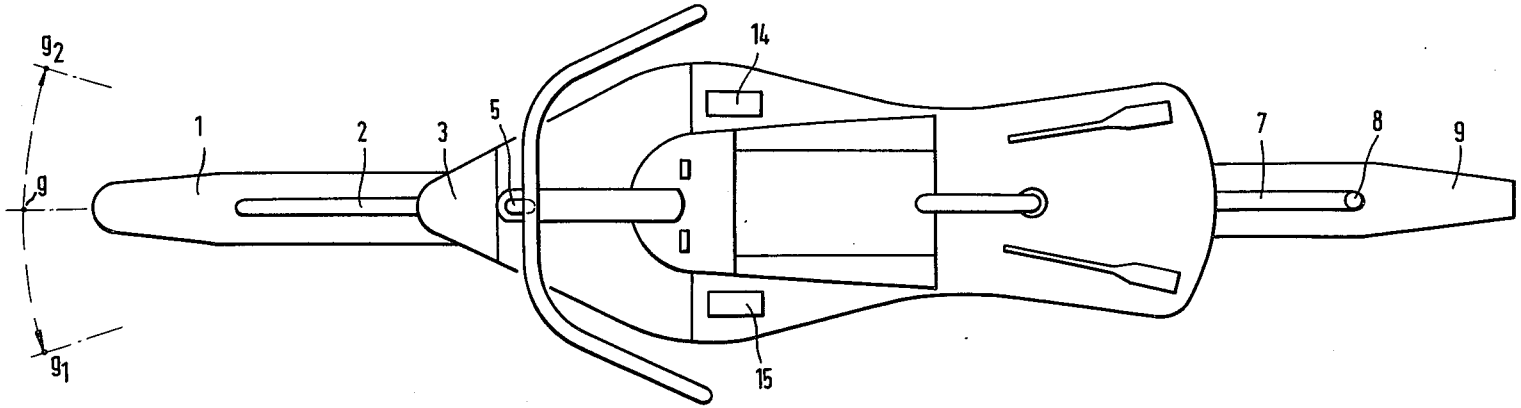
FIG. 2 shows a top view of the watercraft.

As shown in FIG. 1, the watercraft has a float 3 designed as a hollow body, which is attached to two skis 1 and 9 arranged in tandem. The front ski 1 is articulated over a swivel joint 16 on a steering column 5, and a telescopic spring 13 with a shock absorber is arranged between the swivel joint and the steering column 5. The steering column 5 passes through a slot as shown in FIG. 2 (unnumbered) in the float 3 in its front part, and is mounted in a guide bushing 4. In front of the steering column 5, as seen in traveling direction, is arranged a vibratory spring 2 to cushion the swivel movement of the ski 1 about the swivel joint 16. This vibratory spring 2 is articulated in the front part of the ski 1 and on the steering column 5 just below the guide bushing 4, and forms this way with the steering column 5 in a side view a rearwardly opening V. The vibratory spring 2, which is incidentally likewise combined with a shock absorber, permits swivel movements of the ski 1 about the swivel joint 16 at the bottom end of the telescopic spring 13 in the angular range defined by *a*1-*a*-*a*2 at the front end and by *a*2'-*a*'-*a*1' at the rear end of ski 1.

Guide bushing 4 for steering column 5 is not secured rigidly on float 3, but is mounted on float 3 at its lower rear end by means of a pivotal connection 17 whose axis extends horizontally in the transverse direction. This articulated joint permits a tilting movement of steering column 5 in the angular range defined by *b-b*1. This has the result that the upper end of steering column 5, which is designed as a handlebar, tilts in the angular range defined by *c-c*1, and the lower end of steering column 5 in the angular range defined by *f-f*1, when guide bushing 4 pivots in the indicated angular range. The front ski 1 moves at the front end from *a* to *a*1 and at the rear end from *a'* to *a'*1, so that the front ski 1 can be inclined obliquely by the pivotal movement of guide bushing 4, and thus of steering column 5.

At the rear end of float 3 is arranged on its underneath side a rigid strut 7 which is inclined to the rear by 30° to the vertical, and which is connected likewise by means of a telescopic spring 8 and swivel joint 18 to the rear ski 9. Furthermore, a vibratory spring 10 is so articulated on the front end of rear ski 9 that it forms an inverted V with strut 7. This vibratory spring 10 also permits a tilting movement for the rear ski 9, at the front end in the range *d-d*1-*d*2, and at the rear end in the range *d'-d'*1-*d'*2. The telescopic spring 8 and the vibratory spring 10 are combined with shock absorbers as on front ski 1.

In the central region of the float 3 is arranged the upper part of the motor drive 6 whose design corresponds substantially to that of a conventional outboard motor. This motor 6 has a vertical, downwardly-extending shaft, at the bottom end of which is arranged the screw propeller, with a horizontal propeller axis. The propeller itself is secured by a guard ring 11 against damage and to avoid injuries. The vertical shaft of the motor drive 6 is connected by means of a tie rod 12 with the upper end of guide bushing 4, so that the shaft tilts from *e* to *e*1, with pivotal movement of the upper end of steering column 5 to the rear from *b* to *b*1. Tie rod 12 is designed as a turnbuckle, and thus the angle of inclination of the driving propeller can be varied additionally in the angular range defined by *e-e*1 by varying the length of tie rod 12.

FIG. 2 shows a top view of the watercraft, in which the skis 1 and 9 are arranged in the longitudinal axis underneath the float 3. Float 3 is designed substantially as a seat for a person, with footrests 14 and 15. The steering column has at its upper end a handlebar like the handlebar of a motorcycle, with which the front ski 1 can be turned in the angular range defined by *g-g*1-*g*2.

During the launching of the watercraft shown in FIGS. 1 and 2, float 3 has sufficient buoyancy so that one or two people, if the watercraft has two seats — can sit on it without sinking. For the start of the watercraft, steering column 5 is pulled to the rear of the slot shown in FIG. 2 (unnumbered) by means of the handlebar, so that it tilts from *c* to *c*1. Steering column 5 likewise thus tilts with guide bushing 4 about pivot 17 from *b* to *b*1. This, in turn, ensures a tilting movement of the swivel joint 16 on the front ski 1 from *f* to *f*1, so that the front end of the front ski 1 describes an arc from *a* to *a*1, and the rear end an arc from *a'* to *a'*1. In this way, the upwardly inclined position of the front ski 1 is obtained, which is necessary for the rising of the watercraft. The vibratory spring 2 and the telescopic spring 13 produce automatically the proper inclination of the front ski 1 when the driver has brought the steering column 5 into the prescribed position. This way the front ski 1 always maintains its optimum position when the boat rises.

Simultaneously with the tilting of steering column 5 to the rear, the shaft of motor drive 6 is tilted from *e* to *e*1 by tie rod 12. This way the propeller axis always maintains its horizontal position during the rising, despite the inclined position of the watercraft, so that the propeller can develop a maximum thrust. This is necessary to raise the rear ski 9, which is already parallel to the float 3, before the front ski rises. This position of the rear ski 9 is corrected during the ride by the vibratory spring 10 and the telescopic spring 13 in dependence on the lifting forces.

After both skis 1 and 9 have surfaced, the ride is continued exclusively on the skis. These carry the entire unit of the water craft with the driver, and the watercraft is only in connection with the water surface at the planing surfaces of the skis 1 and 9 and partly through the motor drive 6. The propeller of the motor drive 6 is always under the water surface, since it is located under the skis 1 and 9.

Changes in direction are achieved, as described above, by turning steering column 5 so that the front ski 1 describes an arc *g*1-*g*-*g*2, as shown in FIG. 2, and the flow forces acting on the front ski 1 effect the change of direction. In the same manner, jump can also be effected with the watercraft, in that the steering column 5, as in rising is pulled to the rear by a sudden movement of the handlebar. In the same manner is also effected a sudden deceleration or braking, where bottom surfaces of the front ski 1 act as a brake, and motor drive 6 is shut off at the same time.

What I claim is:

1. A watercraft comprising, in combination:

an elongated displacement flotation body having at least one seat thereon for a rider, said body having its longitudinal axis extending generally parallel to the direction of forward travel;

front and rear skis disposed below said body in tandem arrangement, said front ski being steerable;

spring means connecting said rear ski to said body so as to provide a cushioned connection between them;

a bushing pivotally mounted on said body near the front end thereof, said bushing being tiltable about a transverse horizontal axis;

a steering column extending downwardly and forwardly through said bushing and rotatable therein, the bottom end of said steering column being pivotally attached to said front ski intermediate the ends thereof, whereby the ski can swing through an arc between a first position generally parallel to the direction of travel, and a second position inclined forwardly and upwardly;

a resilient strut connected at one end to said front ski near the forward end thereof, and at its other end to said steering column so as to maintain the front ski at a more-or-less constant angle of attack when the craft is running on the surface of the water; and a motor mounted in said body and having a downwardly extending drive shaft that drives a propeller located below the bottom surfaces of said skis;

said front ski being movable from said first position to said second position at the time the craft is being launched, by a rearward pull on the top end of said steering column, causing said bushing to tilt about its pivot axis and thereby raising the front end of the front ski.

2. A watercraft as in claim 1, wherein said resilient strut is connected to said steering column adjacent the lower end of said bushing, with its axis passing in front of the pivot axis of the bushing, whereby an upward thrust on the strut causes the upper end of the bushing to tilt rearwardly.

3. A watercraft as in claim 1, wherein said drive shaft is swingable about a transverse horizontal axis between a first, generally vertical position, and a second position inclined downwardly and rearwardly; and means operable to tilt said drive shaft to said second position when said front ski is swung to its second position, whereby the rotational axis of the propeller is maintained horizontal when said body is inclined forwardly and upwardly by the action of said front ski in its second position.

4. A watercraft as in claim 3, wherein said means operable to tilt said drive shaft to said second position comprises a strut connected at one end to said drive shaft and at the other end to said bushing above its pivot, whereby rearward movement of the top end of the bushing causes the bottom end of the drive shaft and propeller to swing rearwardly.

5. A watercraft as in claim 4, wherein said strut is adjustable in length to allow the propeller to be adjusted to its most advantageous position.

* * * * *